US009732741B2

(12) United States Patent
Rodrigues et al.

(10) Patent No.: US 9,732,741 B2
(45) Date of Patent: Aug. 15, 2017

(54) HERMETIC COMPRESSOR COMPRISING A SUCTION ACOUSTIC FILTER

(71) Applicant: Whirlpool, S.A., São Paulo-SP (BR)

(72) Inventors: Tadeu Tonheiro Rodrigues, Joinville (BR); Talita Wajczyk, Joinville (BR); Jose Nilton Fonseca, Jr., Catanduva (BR)

(73) Assignee: Whirlpool, S.A., Sao Paulo, SP (BR)

( * ) Notice: Subject to any disclaimer, the term of this patent is extended or adjusted under 35 U.S.C. 154(b) by 0 days.

(21) Appl. No.: 15/023,614

(22) PCT Filed: Sep. 18, 2014

(86) PCT No.: PCT/BR2014/000340

§ 371 (c)(1),
(2) Date: Mar. 21, 2016

(87) PCT Pub. No.: WO2015/039204

PCT Pub. Date: Mar. 26, 2015

(65) Prior Publication Data

US 2016/0208788 A1 Jul. 21, 2016

(30) Foreign Application Priority Data

Sep. 19, 2013 (BR) ..... BR202013024030 9

(51) Int. Cl.
*F01N 1/14* (2006.01)
*F04B 39/00* (2006.01)
(Continued)

(52) U.S. Cl.
CPC ..... *F04B 39/0027* (2013.01); *F01N 13/007* (2013.01); *F04B 39/0061* (2013.01); *F04B 39/12* (2013.01); *F04C 29/065* (2013.01)

(58) Field of Classification Search
CPC ..... F04B 39/00277; F04B 39/0061; F01N 13/0007; F04C 39/12
(Continued)

(56) References Cited

U.S. PATENT DOCUMENTS 4,582,468 A 4/1986 Bar
6,017,197 A * 1/2000 Jensen ..... F04B 39/0055 181/249
(Continued)

FOREIGN PATENT DOCUMENTS

WO 2005075828 A1 8/2005
WO WO 2005088126 A1 * 9/2005 ..... F04B 39/0061

OTHER PUBLICATIONS

International Search Report and Written Opinion issued in counterpart International Patent Application No. PCT/BR2014/000340 dated Dec. 22, 2014 by the European Patent Office.
(Continued)

*Primary Examiner* — Forrest M Phillips
(74) *Attorney, Agent, or Firm* — Harrington & Smith

(57) ABSTRACT

The present utility model application refers to a new constructive arrangement introduced in acoustic filter of hermetic compressor, and more particularly, a new constructive arrangement that optimizes the suction flow of the acoustic filter, which is normally arranged within the hermetic housing of the hermetic compressor. The suction acoustic filter (1) is composed by at least one outlet pipe (2), outlet pipe (2) comprising at least two independent suction outlets (21). Each independent suction outlet (21) extending along outlet pipe (2).

6 Claims, 1 Drawing Sheet

(51) Int. Cl.

| | |
|---|---|
| ***F01N 13/00*** | (2010.01) |
| ***F04B 39/12*** | (2006.01) |
| ***F04C 29/06*** | (2006.01) |

(58) Field of Classification Search
USPC ..... 181/262
See application file for complete search history.

(56) References Cited

U.S. PATENT DOCUMENTS

| | | | | |
|---|---|---|---|---|
| 6,149,402 | A | 11/2000 | Kim | |
| 6,280,153 | B1 | 8/2001 | Iversen et al. | |
| 7,959,416 | B2 * | 6/2011 | Bosco, Jr. | F04B 39/0072 181/229 |
| 8,434,586 | B2 * | 5/2013 | Pawelski | F04C 29/065 181/175 |
| 2002/0185333 | A1 * | 12/2002 | Svendsen | F04B 39/0061 181/229 |
| 2007/0212234 | A1 * | 9/2007 | Murata | F04B 39/0072 417/312 |

OTHER PUBLICATIONS

International Preliminary Report on Patentability issued in counterpart International Application No. PCT/BR2014/000340 dated Jul. 20, 2015 by the European Patent Office.

* cited by examiner

HERMETIC COMPRESSOR COMPRISING A SUCTION ACOUSTIC FILTER

CROSS-REFERENCE TO RELATED APPLICATIONS

This application is a U.S. National Stage of International Patent Application No. PCT/BR2014/000340, filed on 18 Sep. 2014, which claims priority to Brazilian Patent Application No: BR2020130240309, filed on 19 Sep. 2013. The disclosure of both applications are incorporated herein by reference in their entirety.

FIELD OF THE UTILITY MODEL

The present utility model patent refers to a new constructive arrangement introduced in acoustic filter of hermetic compressor, and more particularly, a new constructive arrangement that optimizes the suction flow of the acoustic filter, which is usually arranged within the hermetic housing of the hermetic compressor.

BACKGROUND OF THE UTILITY MODEL APPLICATION

As is known to those skilled technicians in the art, fluid compressors, and especially fluid compressors used in refrigeration systems comprise (among many other functional components) suction acoustic filters and discharge acoustic filter.

In general, said acoustic filters comprise volumetric chambers arranged within the compressor hermetic housing, between the output and input of the compression cylinder and the inlet or outlet pipe of the compressor hermetic housing.

The function and the functional principle of the acoustic filters are longtime known to the technicians skilled in the subject matter. It's knows, therefore, that said acoustic filters—suction or discharge filters—aim to reduce the noise caused by the functional pulse of the compressor.

One major difference between a discharge acoustic filter and a suction acoustic filter, in hermetic compressors, consists of the fact that the discharge acoustic filter has the volume thereof isolated from the inner environment of the hermetic housing of the compressor, while the suction acoustic filter has the input thereof in constant fluid communication with the interior of the compressor hermetic housing.

It means that a discharge acoustic filter is directly connected—via specific pipes—to the compression cylinder, inside the hermetic housing, and to the cooling line, outside the compressor housing.

Therefore, there is no important problem regarding the constructiveness of the in let and/or out let connections and/or joints of acoustic filters. This is because they have the inlets and/or outlets thereof welded to the pipes.

The same does not occur with a suction acoustic filter, after all, this is directly connected only to the compression cylinder, the other end thereof (or pipe) arranged within the hermetic housing, and it may or may not be connected to the suction line of the cooling system, and usually there is no such direct connection. This is because it is preferred that the entire volume of the compressor hermetic housing is equalized with the pressure of said suction line of the cooling system.

Therefore, there is a special care with the outlet pipe of the suction acoustic filters of hermetic compressors. In this sense, one can observe that the current state of the art provides fundamentally special constructions for pipes of suction acoustic filters.

Document U.S. Pat. No. 6,280,153 describes, for example, an outlet pipe of a suction acoustic filter-pipe connected to the compression cylinder of the hermetic compressor—the constructivity thereof in steps aims to minimize the contact edges which may represent barriers to the suction flow.

Document WO2005075828 also describes, for example, an outlet pipe of a suction acoustic filter—pipe connected to the compression cylinder of the hermetic compressor—the constructivity there of in duplicate aims to provide fluid flow to two suction valves.

It is also known a constructivity of suction acoustic filter where the inlet pipe—pipe free of connection and freely arranged inside the hermetic compressor housing—has two suction holes. This embodiment is relatively conventional, and it can best be seen in FIG. 1.

As can be assessed by observing FIG. 1, two suction holes are provided in a same suction inlet pipe of a suction acoustic filter. The main objective of the embodiment illustrated in FIG. 1 is to obtain, from the smallest possible dimensions (a single suction pipe) the greater possible suction capacity (double inlet).

However, the greater suction capacity of the embodiment illustrated in FIG. 1 is proportional to the diameter of the single pipe, rather than the number of inlet holes. Moreover, the fluid flow sucked by one of the holes can also impair the fluid flow sucked by the other hole.

Thus, the present utility model patent arises based on the general perspective (where it is noted a concerned with the outlet pipe greater than with the inlet pipe of the suction acoustic filters of hermetic compressors).

OBJECTIVES OF THE UTILITY MODEL APPLICATION

Thus, it is one of the goals of this utility model application to provide a suction acoustic filter whose outlet pipe has more than one outlet hole, and each hole has its own pipe responsible for directing the flow of coolant to their respective valves.

It is still one of the goals of this utility model application that the gas sucked into the cylinder through the suction holes has a similar amount of fluid, allowing a dynamic of the suction valves more homogeneous and synchronized with impacts on efficiency and noise through the reduction of the pulsation suction range.

SUMMARY OF THE UTILITY MODEL APPLICATION

These and other objectives of the utility model application now disclosed are fully achieved through the constructive arrangement introduced in acoustic filter of hermetic compressor now disclosed.

According to the present utility model application, the suction acoustic filter is composed of at least one outlet pipe, which comprises at least two independent suction outlet, each independent suction outlet independently extending along the outlet pipe.

Further, and in accordance to the present utility model application, the independent suction outlet are spaced apart by at least one wall, and the tubular extensions of each independent suction outlet are isolated from each other by at least one vertical projection arranged along the outlet pipe.

Preferably, at least one of the independent suction outlet (21) is curvilinear. Optionally, at least one of the independent suction outlet is straight.

Most preferably, the outlet pipe can be projected from the top of the suction acoustic filter.

In addition, and yet according to the present utility model application, it is noted that, preferably, the tubular extensions have lengths different from each other.

BRIEF DESCRIPTION OF THE DRAWINGS

This utility model application will be described in detail based on the figures listed below, which.

DETAILED DESCRIPTION OF THE UTILITY MODEL APPLICATION

Figure 1:
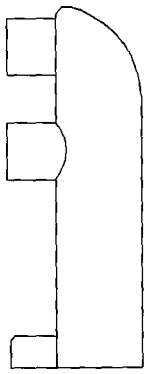
FIG.1 (PRIOR ART)
FIG. 1 illustrates, in simplified form, the inlet pipe of a suction acoustic filter according to the current state of the art.

According to the objectives of the present utility model application, it was designed an acoustic filter of hermetic compressor whose main purpose is to provide more than one outlet hole in a single main pipe, in order to provide suction flows better distributed compared to that of the state of the art shown in FIG. 1.

Figure 2:
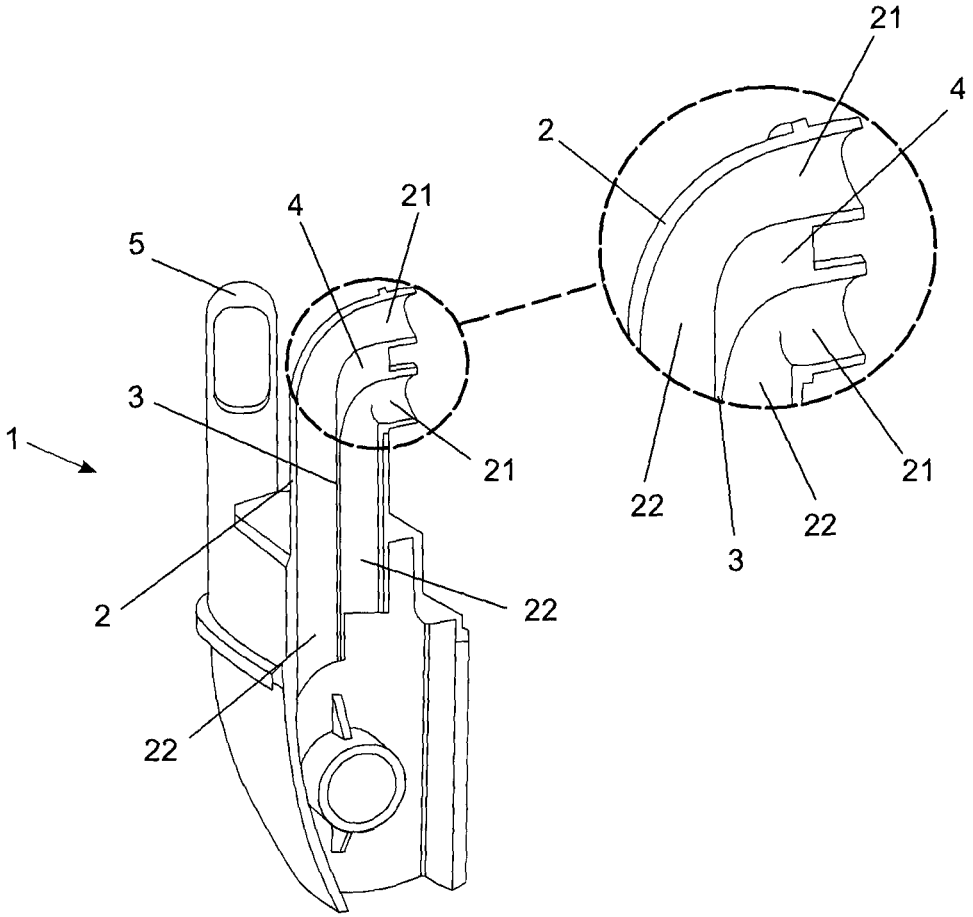
FIG. 2 schematically illustrates a preferred embodiment of the constructive arrangement introduced in acoustic filter of hermetic compressor disclosed herein.

FIG. 2, as well as the enlarged detail thereof, illustrates a preferred embodiment of the acoustic filter of hermetic compressor according to the objectives of the present utility model application.

The preferred embodiment illustrates a suction acoustic filter 1 comprised of a two-part body and preferably made of polymeric alloy (engineering plastic). The outlet pipe 2 (discharge of the muffler/suction inlet to the cylinder) and outlet pipe 5 (suction of the muffler) are vertically projected in the upper part of the two-part body.

According to the scope of the present utility model application, whose focus comprises the outlet pipe 2, it is worth to mention that other functional details within the knowledge of the technician skilled on the subject matter are not explained in detail from the present detailed description.

Still referring to FIG. 2, it is noted that the aforementioned outlet pipe 2 comprises two independent suction outlets 21.

Obviously, there could be more than two independent suction outlets 21 in a single outlet pipe 2, and this ratio is preferably defined in accordance with the number of suction valves (not shown) or according to the number of suction holes present in the valve-plate (not shown). Consequently, it can be stated that the preferred embodiment herein detailed is preferably suitable for a hermetic compressor integrated by two suction valves or two suction holes defined in the valve-plate (however, there are two suction ways).

As best illustrated in the enlarged detail of FIG. 2, it is noted that the independent suction outlets 21 are spaced apart by at least one wall 4. The thickness of wall 4, that is, the actual distance between each independent suction outlets 21 is set according to the desired application and design, what is important in this case is the arrangement of said wall to form the two independent outlets.

Each of the independent suction outlets 21 extends independently along the outlet pipe 2, forming a tubular extension 22.

Since there are two independent suction outlets 21, it can be seen that there are two tubular extensions 22, which are isolated from each other by a vertical projection 3 that, starting from wall 4, is arranged along outlet pipe 2, and more particularly, until the final end of said tubular extensions 22.

It is worth mentioning that, optionally, tubular extensions 22 may have lengths and diameters different from each other. This is because the dynamics of the valve is influenced due to the length and diameter of the tubes. These values can be adjusted to obtain the best performance with respect to the thermodynamic efficiency and the acoustics.

Further, independent suction outlets 21 may be curvilinear or straight, the setting between one possibility or another is based on additional conventional aspects of the hermetic compressor itself (not shown).

The existence of independent suction outlet 21 on a single outlet pipe 2 (discharge pipe of the muffler/suction pipe to the cylinder) allows balancing the amount of fluid discharged by suction acoustic filter 1, thereby enabling similar movement of the suction valves (not shown), which ends up resulting in performance and pulse gains of the hermetic compressor.

Having described an example of preferred embodiment of the object of this utility model application, it should be understood that the scope thereof encompasses other possible variations, which are solely limited by the wording of the claims, including therein the possible equivalents means.

The invention claimed is:

1. A Hermetic compressor comprising:

A suction acoustic filter integrated by at least one outlet pipe and characterized by the fact that:

The at least one outlet pipe comprises at least two independent suction outlets;

each independent suction outlet independently extending along the at least one outlet pipe forming a tubular extension;

wherein the tubular extensions include a first vertical section and a second horizontal outlet section;

the outlet sections being divided by at least one wall;

the tubular extensions of each independent suction outlet are isolated from each other by at least one projection arranged along the at least one outlet pipe;

wherein the projection extends from the wall and through the outlet pipe so as to divide the tubular extensions along their entire length.

2. Hermetic compressor comprising the suction acoustic filter according to claim 1, CHARACTERIZED by the fact that at least one of the independent suction outlets is curvilinear.

3. Hermetic compressor comprising the suction acoustic filter according to claim 1, CHARACTERIZED by the fact that at least one of the independent suction outlets is straight.

4. Hermetic compressor comprising the suction acoustic filter according to claim 1, CHARACTERIZED by the fact that the at least one outlet pipe is projected from the top of the suction acoustic filter.

5. Hermetic compressor comprising the suction acoustic filter according to claim 1, CHARACTERIZED by the fact that the tubular extensions have lengths different from each other.

6. Hermetic compressor comprising the suction acoustic filter according to claim 1, CHARACTERIZED by the fact that the tubular extensions have diameters different from each other.

* * * * *